US006835081B2

(12) United States Patent
Plattner et al.

(10) Patent No.: US 6,835,081 B2
(45) Date of Patent: Dec. 28, 2004

(54) SNAP FIT MODULAR ELECTRICAL DISTRIBUTION BLOCK

(75) Inventors: Brad W Plattner, Kendallville, IN (US); Dan L. Hayes, Kendallville, IN (US); Shawn J. Kondas, Kendallville, IN (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 10/303,250

(22) Filed: Nov. 25, 2002

(65) Prior Publication Data

US 2004/0102072 A1 May 27, 2004

(51) Int. Cl.[7] ..... H01R 4/60
(52) U.S. Cl. ..... 439/215
(58) Field of Search ..... 439/215, 210, 439/211, 650

(56) References Cited

U.S. PATENT DOCUMENTS

| | | | | |
|---|---|---|---|---|
| 3,601,755 A | | 8/1971 | Shiells, Jr. | 339/19 |
| 3,740,698 A | | 6/1973 | Jerominek | 339/17 |
| 3,922,478 A | * | 11/1975 | Perkey | 174/53 |
| 5,013,252 A | | 5/1991 | Nienhuis et al. | 439/215 |
| 5,035,636 A | | 7/1991 | Hollingsworth | 439/215 |
| 5,092,787 A | * | 3/1992 | Wise et al. | 439/215 |
| 5,104,332 A | | 4/1992 | McCoy | 439/290 |
| 5,203,711 A | | 4/1993 | Bogiel | 439/215 |
| 5,509,827 A | | 4/1996 | Huppenthal et al. | 439/638 |
| 6,186,825 B1 | * | 2/2001 | Bogiel et al. | 439/532 |

FOREIGN PATENT DOCUMENTS

| | | | |
|---|---|---|---|
| DE | 463 631 | 7/1928 | 201/26 |
| WO | WO 93/08624 | 4/1993 | H01R/31/06 |

* cited by examiner

*Primary Examiner*—Phuong Dinh
(74) *Attorney, Agent, or Firm*—Taylor & Aust, P.C.

(57) ABSTRACT

A modular electrical component for use in modular office furniture, comprising a housing including a plurality of housing parts, the housing parts being releasably engaged with each other, at least one of the housing parts including a plurality of internal locating features, and at least one of the housing parts including at least one electrical connector port, a plurality of terminals, each terminal being positionable in the housing parts relative to at least one of the plurality of locating features, each terminal having a plurality of ends including one end associated with a respective electrical connector port, and at least one releasable lock, each lock being associated with at least two of the plurality of housing parts and effecting releasable engagement between the housing parts.

19 Claims, 5 Drawing Sheets

SNAP FIT MODULAR ELECTRICAL DISTRIBUTION BLOCK

BACKGROUND OF THE INVENTION

1. Field of the Invention

The present invention relates to modular electrical distribution systems, and, more particularly, to modular electrical distribution blocks used with distribution harnesses in a modular furniture environment.

2. Description of the Related Art

Distribution harnesses are known within a modular furniture environment to distribute electrical utilities within and to various modular wall panels. A typical distribution harness may include at least two end connectors, each end connector connected to a channel enclosing at least one conductor. The conductors are interconnected via an electrical distribution block which has a plurality of terminals corresponding to and interconnecting the conductors. The distribution block includes a housing which encloses the terminals and the ends of the conductors, and terminates the channel at the channel ends opposite of the end connectors. The distribution block can typically include ports in the housing which electrically connects the terminals, and thus the channel conductors, to electrical devices such as electrical receptacle outlets.

A typical housing can be an overmolded plastic one piece design. Such a housing requires that the conductors are installed in their respective channels or wire conduits and interconnected via the terminals, then the housing is molded over the terminals, conductor ends and wire conduit ends using an insert injection molding process. An insert injection molding process requires an insert injection molding machine, relatively expensive molds, and importantly, may have a machine cycle time of sixty seconds or more. Additionally, a cooling time may be required for the housing before normal handling of the housing and harness thereby increasing the effective machine cycle time. If the demand rate is less than the machine cycle time, (i.e., the customer demand requires harnesses be made in less than the machine cycle time), or if economic or competitive pressures require a shorter cycle time, overtime or multiple shifts are required, or additional machines and molds, or multiple cavity molds. All of the previously mentioned options have substantial price associated therewith.

The manufacturing of a distribution harness with an overmolded housing for the distribution block is additionally paced by the injection molding machine reliability and mold reliability. If the machine goes down, or the mold needs repair, the harness production stops unless spare machines or molds are available. Environmental conditions such as relative humidity or other contamination may further negatively impact production efficiencies of the molding process by increasing the amount of defective parts.

An overmolded distribution block housing is inherently inflexible relative to any post assembly modifications. For example, if a harness, including end connectors, channels and distribution block, has a capacity for eight conductors, but only four conductors are originally installed, the distribution block housing must be destroyed to add the additional connectors.

What is needed in the art is an electrical distribution block design and method, for distribution harnesses, which does not require the use of an insert injection molding process for manufacturing of the distribution block, and which provides for an easy and reliable mating and unmating of distribution block housing parts in a time efficient manner.

SUMMARY OF THE INVENTION

The present invention provides a modular electrical distribution block with snap fit housing parts.

The invention comprises, in one form thereof, a modular electrical component for use in modular office furniture, including a housing with a plurality of housing parts. The housing parts are being releasably engaged with each other. At least one of the housing parts includes a plurality of internal locating features, and at least one of the housing parts includes at least one electrical connector port. A plurality of terminals, are positionable in the housing parts relative to at least one of the plurality of locating features. Each terminal has a plurality of ends including one end associated with a respective electrical connector port. At least one releasable lock is provided, with each lock being associated with at least two of the plurality of housing parts and effecting releasable engagement between the housing parts.

An advantage of the present invention is the reduced manufacturing time required to assemble the distribution block and distribution harness.

Another advantage is the housing parts of the present invention are releasably engaged thereby allowing post assembly modification of the electrical distribution block and harness without the need to destroy the distribution block or harness assembly.

Yet another advantage of the present invention is the elimination of insert injection molding machines and associated molds in the manufacturing assembly of the distribution block and distribution harness.

A further advantage of the present invention is the presence of locating features in the housing parts for properly locating terminals thereby simplifying and error proofing the assembly process.

A yet further advantage of the present invention is the presence of mating edges in the distribution block housing parts allowing a repeatable and reliable interconnection of housing parts.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
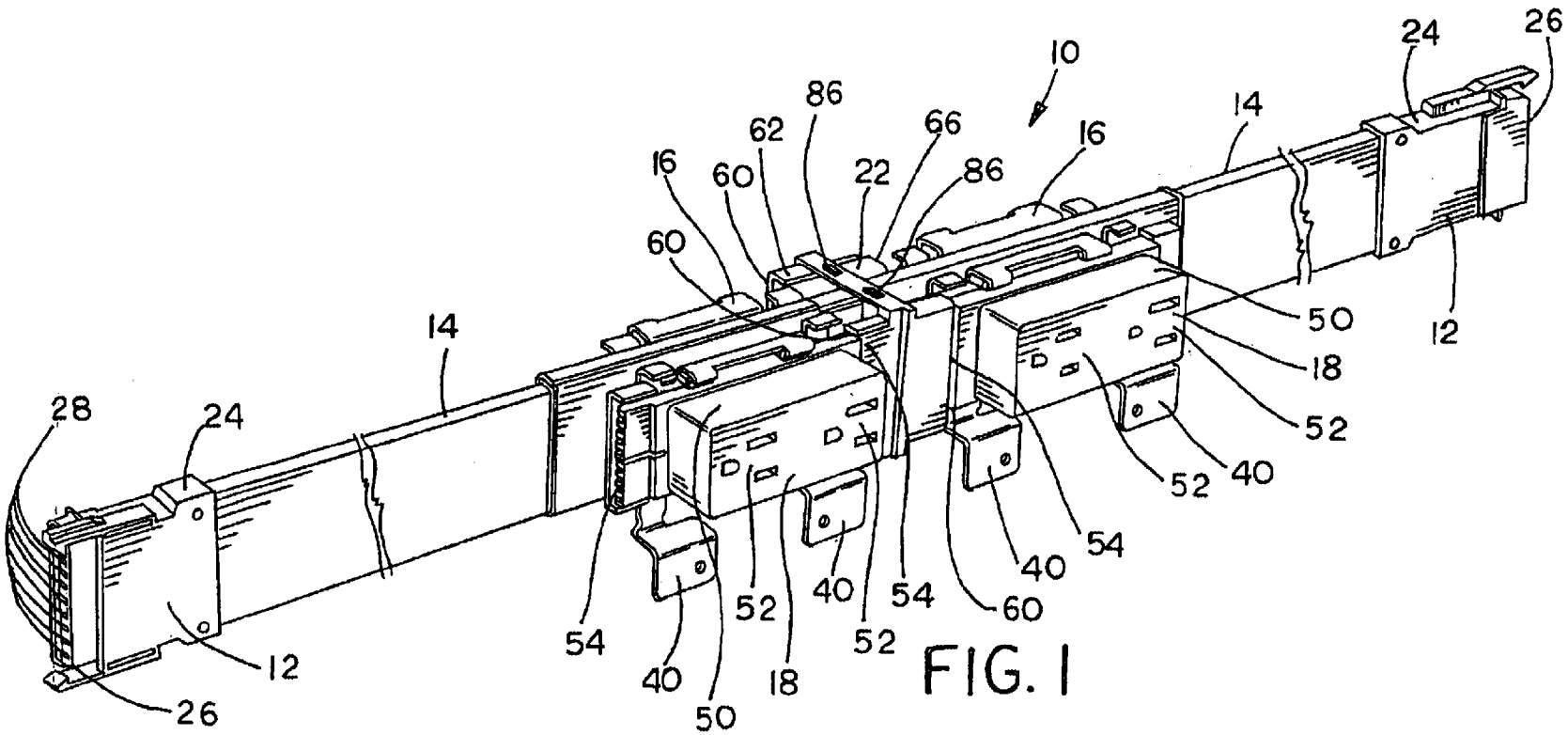
FIG. 1 is a perspective view of an assembled distribution harness showing an embodiment of the snap fit distribution block of the present invention.

Referring now to the drawings, and more particularly to FIG. 1, there is shown an electrical distribution harness 10 which generally includes end connectors 12, wire conduits 14, brackets 16, receptacles 18, conductors 20 (FIG. 2) and electrical distribution block or modular electrical component 22. Electrical distribution harness 10 is generally attached to a frame of a modular wall panel (not shown) using brackets 18 and is enclosed within the same modular wall panel.

End connectors 12 includes end connector housing 24 with end connector port 26 and enclosing end connector terminals 28. End connector terminals 28 are electrically connected to conductors 20 within wire conduits 14. End connector ports 26 can be connected to jumper cables (not shown), other distribution harnesses (not shown), electrical devices (not shown) or sources of electrical utilities (also not shown).

Wire conduits 14 mechanically connect at one end thereof to end connectors 12 and enclose conductors 20. The other end of wire conduits 14 connect to respective sides of distribution block 22.

Brackets 16 attach to wire conduit 14 and hold electrical distribution harness 10 to the frame of a modular wall panel (not shown) using feet 40. Bracket clips 42 of brackets 16 mechanically hold receptacles 18 to electrical distribution harness 10. Other embodiments of bracket 16 are possible.

Receptacle housing 50 of receptacle 18 mechanically connects to bracket 16. Housing 50 includes receptacle ports 54 which electrically connect to electrical connector ports 60, thereby connecting outlets 52 to a source of electrical power (not shown) through distribution harness 10. Housing clips 56 releasably engage bracket clips 42 to mechanically hold receptacle 18 to bracket 16.

Electrical distribution block or modular electrical component 22 (FIG. 2) includes electrical connector ports 60, housing 62 and terminals 68. Terminals 68 electrically connect electrical connector ports 60 to conductors 20. Electrical distribution block 22 is shown as an H-shaped distribution block including four ports 60 wherein a given H-shaped terminal 68 simultaneously connects all four ports 60 to a given conductor 20 by terminating each terminal end 70 in a different port 60. Conductors 20 are terminated in electrical distribution block 22 at terminal connector 74 which is shown as a crimp connection but may be a soldered or welded connection.

Figure 2:
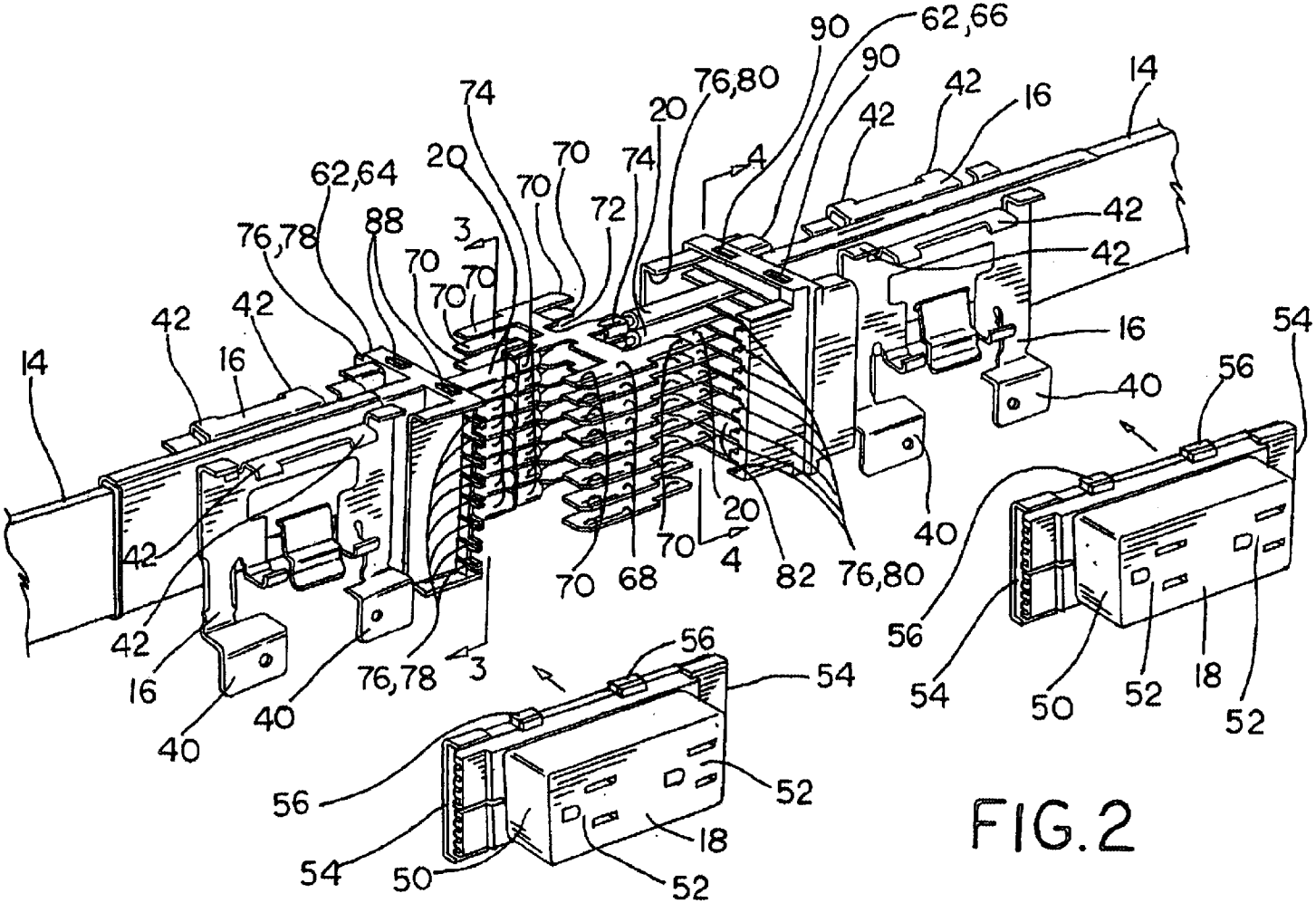
FIG. 2 is an exploded, perspective view of a distribution harness showing an embodiment of the snap fit distribution block of the present invention.
Figure 4:
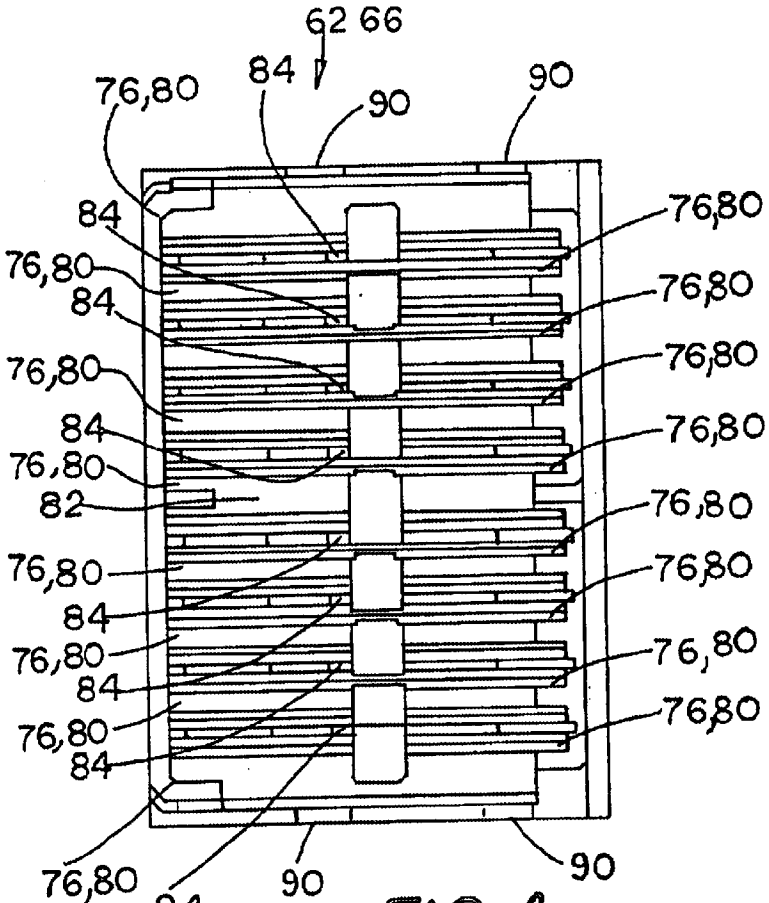
FIG. 4 is a sectional view of a snap fit embodiment of the female housing part of the present invention shown in FIG. 2 as viewed from section line 4—4.
Figure 3:
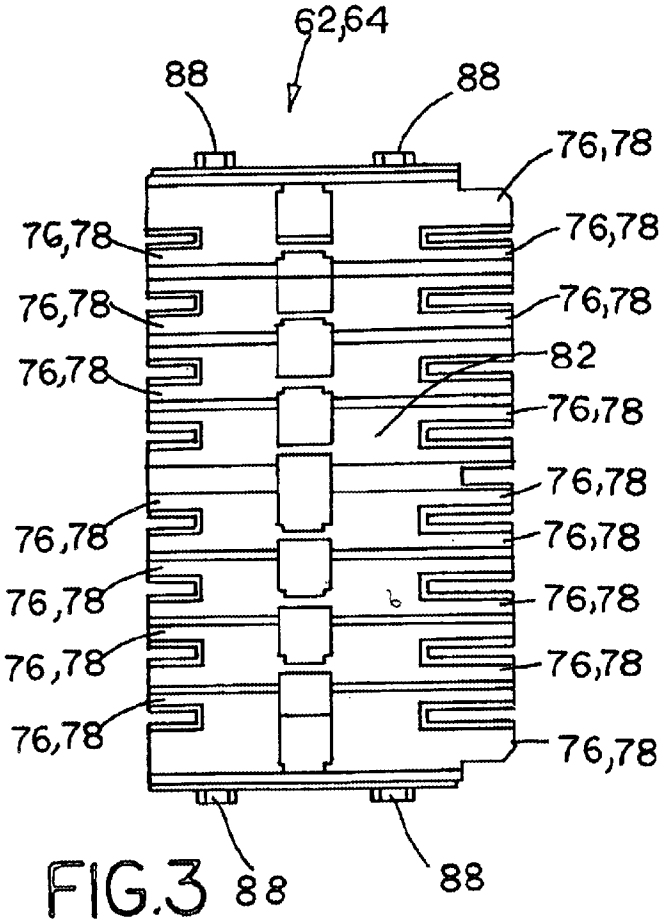
FIG. 3 is a sectional view of a snap fit embodiment of the male housing part of the present invention shown in FIG. 2 as viewed from section line 3—3.

Housing 62 includes at least a male housing part 64 and female housing part 66. Male housing part 64 and female housing part 66 are repeatably positionable to configure housing 62 by the juxtaposition of housing part mating edges 76 such as male part projecting edges 78 in male housing part 64 and female part recessed edges 80 in female housing part 66 as shown in FIGS. 2, 3 and 4. Housing part inside portion 82 includes internal locating features such as tabs 84 in female housing part 66 which mate with terminal locating recesses 72 in each terminal 68 to maintain the proper orientation of terminals 68 in housing 62, and to exclude incorrect orientations of terminals 68 in housing 62 during assembly.

Housing 62 further includes snap fitting releasable lock 86 with ramped projection 88 and recess or opening 90. As housing parts 64 and 66 are brought together, and housing part mating edges 76 are juxtaposed, ramped projections 88 deflect slightly until housing parts 64 and 66 are in a closed position, respective of each other, at which point ramped projections 88 spring and lock into recesses 90. The opening of housing 62 is achieved by simultaneously deflecting ramped projections 88 and pulling apart housing parts 64 and 66.

In use, electrical distribution harness 10 is assembled by pulling conductors 20 through wire conduits 14 and housing parts 64 and 66. Terminals 68 are positioned within housing parts 64 and 66 matching terminal locating recesses 72 in each terminal 68 with corresponding internal locating features 84. Conductors 20 are individually connected, at an end, to a respective terminal 68. Wire conduits 14 are connected to a respective housing part 64 or 66, and housing parts 64 and 66 are joined together. When housing parts 64 and 66 are completely joined they lock via snap fitting releasable lock 86. Conductors 20 are connected at their other end to end connector terminals 28. End connectors 12 are connected to their respective wire conduits 14. Brackets 16 and receptacles 18 are mounted and connected to electrical distribution harness 10 as required. Electrical distribution harness 10 is mounted in a modular wall panel (not shown) and end connector ports 26 are connected to jumper cables (not shown), other distribution harnesses (not shown), electrical devices (not shown) or sources of electrical utilities (also not shown). Electrical connector ports 60 in electrical distribution block 22 can be connected to other receptacles 18 or electrical devices (not shown).

Figure 5:
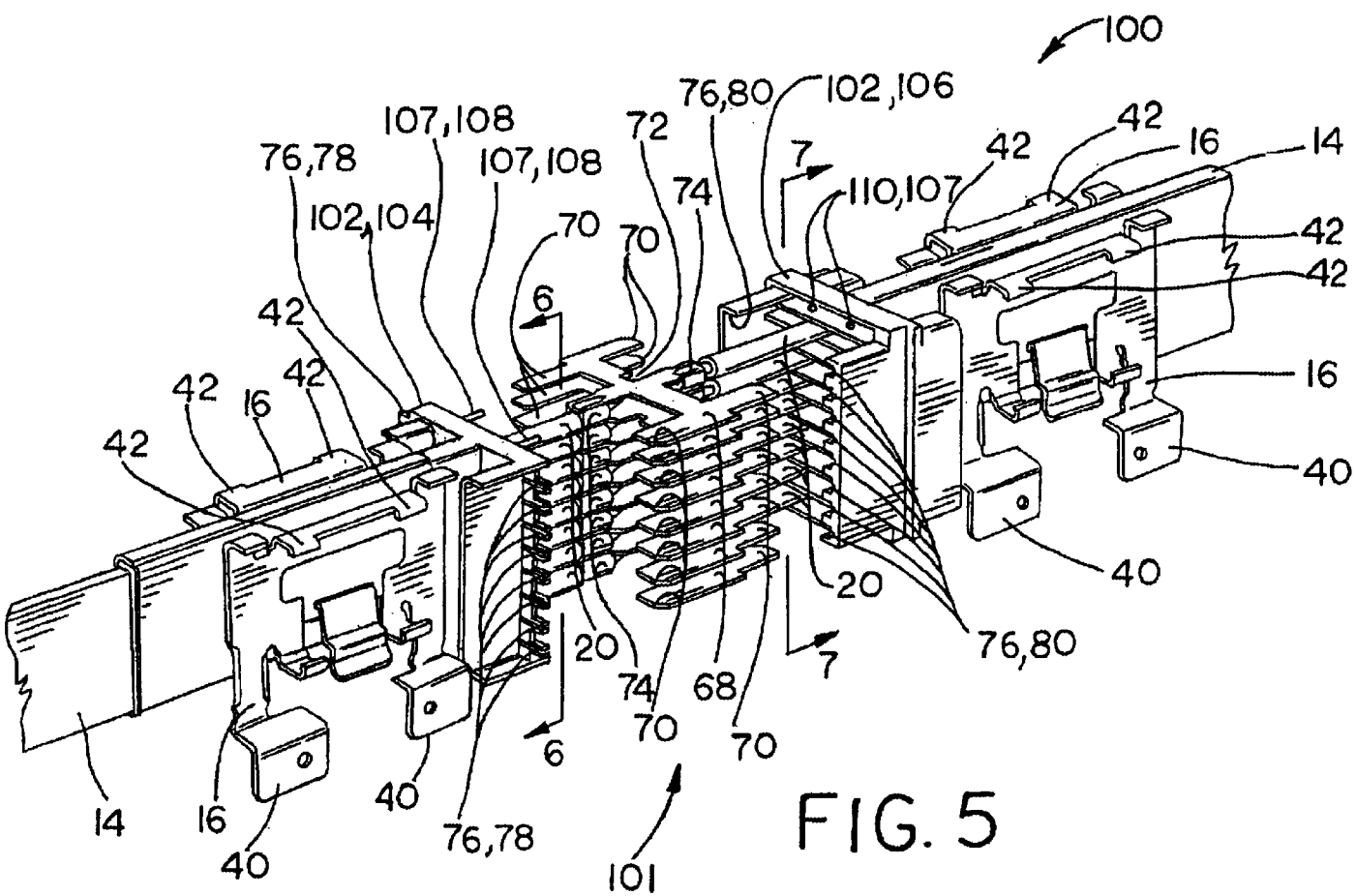
FIG. 5 is an exploded, perspective view of a distribution harness showing a staked fit distribution block embodiment of the present invention.
Figure 7:
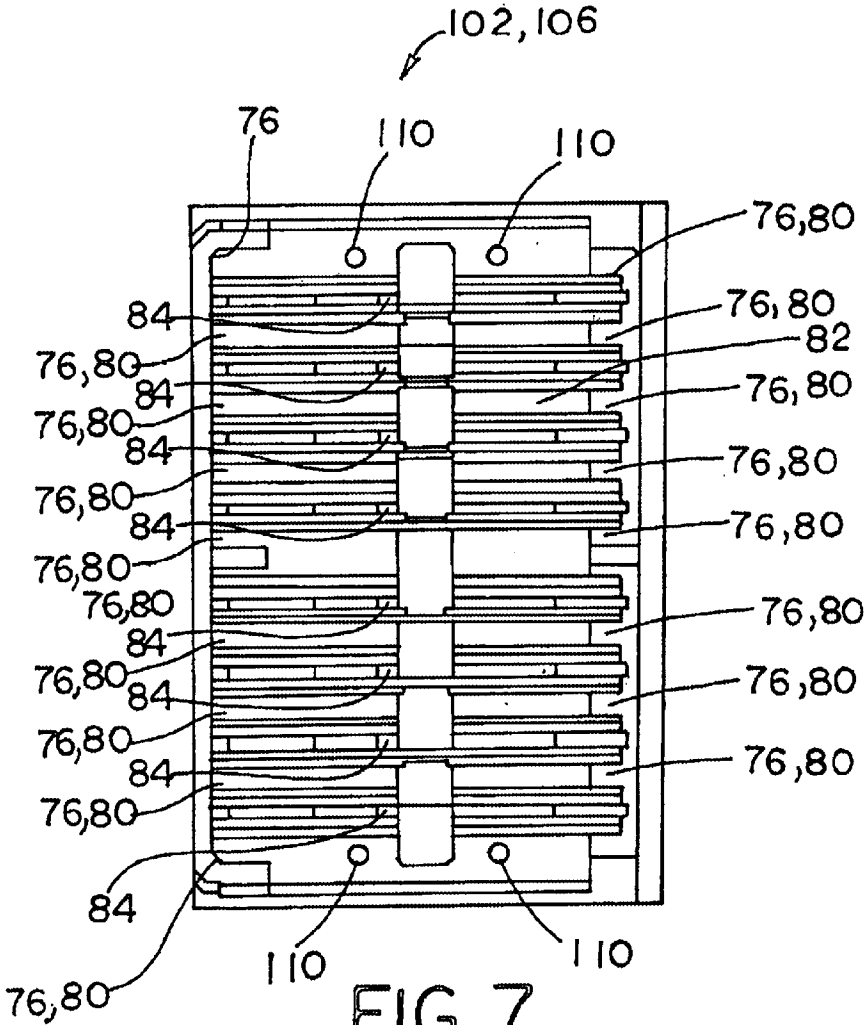
FIG. 7 is a sectional view of a staked fit embodiment of the female housing part of the present invention shown in FIG. 5 as viewed from section line 7—7.
Figure 6:
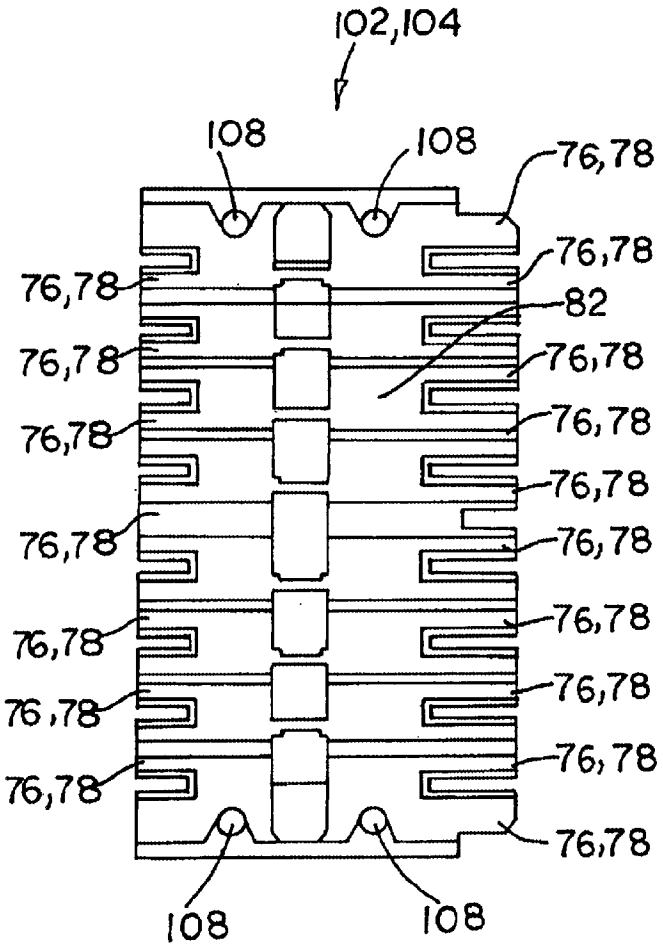
FIG. 6 is a sectional view of a staked fit embodiment of the male housing part of the present invention shown in FIG. 5 as viewed from section line 6—6.

In another embodiment (FIGS. 5–7), electrical distribution harness 100 includes staked fit electrical distribution block or modular electrical component 101 including housing 102. Housing 102 includes staked fitting releasable lock 107 having cylindrical projections 108 on female housing part 106 and circular recesses 110 on male housing part 104. Other components are as described in the previous embodiment. In use, the locking of the embodiment of FIGS. 5–7 includes joining male housing part 104 and female housing part 106, in part, through the insertion of cylindrical projections 108 into respective circular recesses 110. After the complete joining of male housing part 104 and female housing part 106, the locking of the respective housing parts includes staking an end of cylindrical projections in place using a heat gun, and/or compression, or other methods. Other components of electrical distribution harness 100 are the same as the previous embodiment.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A modular electrical component for use in modular office furniture, comprising:

an H-shaped housing including a first housing part and a second housing part, said first housing part being releasably engaged with said second housing part, said first housing part approximately symmetrical with said second housing part, at least one of said first housing part and said second housing part including a plurality of internal locating features, and at least one of said first housing part and said second housing part including at least one electrical connector port;

a plurality of terminals, each said terminal being positionable in said first housing part and said second housing part relative to at least one of said plurality of locating features, each said terminal having a plurality of ends including one end associated with a respective said electrical connector port; and at least one releasable lock, each said lock being associated with both of said first housing part and said second housing part and effecting said releasable engagement between said first housing part and said second housing part.

2. The modular electrical component of claim 1, wherein said at least one releasable lock comprises one of a snap fitting and a staked fitting.

3. The modular electrical component of claim 2, wherein each said releasable lock comprises said snap fitting including a ramped projection on one of said first housing part and said second housing part and a recess on an other of said first housing part and said second housing part.

4. The modular electrical component of claim 3, wherein said other of said first housing part and said second housing part includes an opening defining said recess.

5. The modular electrical component of claim 2, wherein each said releasable lock comprises said staked fitting including a cylindrical projection on one of said first housing part and said second housing part and a circular recess on another of said first housing part and said second housing part.

6. The modular electrical component of claim 1, wherein at least one of said first housing part and said second housing part includes an inside portion, and said plurality of locating features is a plurality of tabs on said inside portion, each said terminal being coupleable with a corresponding said tab.

7. The modular electrical component of claim 6, wherein said plurality of terminals each include a locating recess, each said locating recess being coupleable with a corresponding said tab.

8. The modular electrical component of claim 1, wherein said first housing part and said second housing part include mating edges configured to inhibit relative movement therebetween.

9. The modular electrical component of claim 8, wherein said mating edges includes a male part and a female part, said male part includes at least one projecting edge, said female part includes at least one recessed edge, at least one said projecting edge repeatably positionable with at least one said recessed edge.

10. An electrical distribution harness for use in modular office furniture, comprising:

an electrical distribution block, comprising:

an H-shaped housing including a first housing part and a second housing part, said first housing part being releasably engaged with said second housing part, said first housing part approximately symmetrical with said second housing part, at least one of said first housing part and said second housing part, including a plurality of internal locating features, and at least one of said first housing part and said second housing part including at least one electrical connector port;

a plurality of terminals, each said terminal being positionable in said first housing part and said second housing part relative to at least one of said plurality of locating features, each said terminal having a plurality of ends including one end associated with a respective said electrical connector port;

at least one releasable lock, each said lock being associated with both of said first housing part and said second housing part and effecting said releasable engagement between said first housing part and said second housing part; and at least one wire conduit coupled with and extending from said electrical distribution block.

11. The modular electrical component of claim 10, wherein said at least one releasable lock comprises one of a snap fitting and a staked fitting.

12. The modular electrical component of claim 11, wherein each said releasable lock comprises said snap fitting including a ramped projection on one of said first housing part and said second housing part and a recess on an other of said first housing part and said second housing part.

13. The modular electrical component of claim 12, wherein said other of said first housing part and said second housing part includes an opening defining said recess.

14. The modular electrical component of claim 11, wherein each said releasable lock comprises said staked fitting including a cylindrical projection on one of said first housing part and said second housing part and a circular recess on another of said first housing part and said second housing part.

15. The modular electrical component of claim 10, wherein at least one of said first housing part and said second housing part includes an inside portion, and said plurality of locating features is a plurality of tabs on said inside portion, each said terminal being coupleable with a corresponding said tab.

16. The modular electrical component of claim 15, wherein said plurality of terminals each include a locating recess, each said locating recess being coupleable with a corresponding said tab.

17. The modular electrical component of claim 10, wherein said first housing part and said second housing part include mating edges configured to inhibit relative movement therebetween.

18. The modular electrical component of claim 17, wherein said mating edges includes a male part and a female part, said male part includes at least one projecting edge, said female part includes at least one recessed edge, at least one said projecting edge repeatably positionable with at least one said recessed edge.

19. A method of manufacturing a modular electrical component, comprising the steps of:

providing an H-shaped housing including a first housing part and a second housing part, at least one of said first housing part and said second housing part including a plurality of internal locating features, at least one of said first housing part and said second housing part including at least one electrical connector port; a plurality of terminals, each said terminal having a plurality of ends including one end associated with a respective said electrical connector port; and at least one releasable lock, each said lock being associated with both of said first housing part and said second housing part;

positioning said plurality of terminals in said first housing part and said second housing part relative to at least one of said plurality of locating features;

joining said first housing part and said second housing part together; and locking each said lock in a releasable manner and thereby effecting releasable engagement of said first housing part and said second housing part.

* * * * *

UNITED STATES PATENT AND TRADEMARK OFFICE

CERTIFICATE OF CORRECTION

PATENT NO. : 6,835,081 B2
DATED : December 28, 2004
INVENTOR(S) : Plattner et al.

It is certified that error appears in the above-identified patent and that said Letters Patent is hereby corrected as shown below:

Title page,
Item [56], References Cited, U.S. PATENT DOCUMENTS, please insert the following:
-- 5,728, 970 3/1998 Karst et al. 174/48 --.

Column 6,
Line 1, please delete the “,”.

Signed and Sealed this

Seventh Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,835,081 B2
DATED : December 28, 2004
INVENTOR(S) : Plattner et al.

It is certified that error appears in the above-identified patent and that said Letters Patent is hereby corrected as shown below:

Title page,
Item [56], References Cited, U.S. PATENT DOCUMENTS, please insert the following:
-- 5,728, 970 3/1998 Karst et al. 174/48 --.

Column 6,
Line 1, please delete the “,”.

Signed and Sealed this

Fourteenth Day of June, 2005

JON W. DUDAS
*Director of the United States Patent and Trademark Office*